US006170419B1

(12) United States Patent
Prout et al.

(10) Patent No.: US 6,170,419 B1
(45) Date of Patent: Jan. 9, 2001

(54) PRESSER FOOT FOR A SEWING MACHINE

(75) Inventors: Jason Prout; Neil Raven, both of Leeds (GB)

(73) Assignee: AMF Reece, Inc., Richmond, VA (US)

( * ) Notice: Under 35 U.S.C. 154(b), the term of this patent shall be extended for 0 days.

(21) Appl. No.: 09/355,652

(22) PCT Filed: Jan. 29, 1998

(86) PCT No.: PCT/GB98/00188

§ 371 Date: Oct. 8, 1999

§ 102(e) Date: Oct. 8, 1999

(87) PCT Pub. No.: WO98/33967

PCT Pub. Date: Aug. 6, 1998

(30) Foreign Application Priority Data

Jan. 31, 1997 (GB) ..... 9702039
Nov. 25, 1997 (GB) ..... 9724833

(51) Int. Cl.[7] ..... D05B 29/00; D05B 35/10
(52) U.S. Cl. ..... 112/475.17; 112/235
(58) Field of Search ..... 112/235, 136, 112/151, 475.17

(56) References Cited

U.S. PATENT DOCUMENTS 1,300,184 * 1/1919 Mittleberg ..... 112/235
3,370,559 * 2/1968 Longcore ..... 112/235
3,669,049 * 6/1972 Marforio ..... 112/235 X
4,527,492 * 7/1985 Gill ..... 112/470.26
4,644,885 * 2/1987 Bennison ..... 112/470.26
4,928,610 5/1990 Akutsu ..... 112/153

FOREIGN PATENT DOCUMENTS 497861 12/1970 (CH) .
978872 12/1964 (GB) .
2201694 9/1988 (GB) .

* cited by examiner

*Primary Examiner*—Ismael Izaguirre
(74) *Attorney, Agent, or Firm*—Madson & Metcalf

(57) ABSTRACT

A presser foot for a sewing machine having a base section, a support projecting upwardly from the base section for attachment to a sewing machine, and a fulling rod secured to the base section. The base section has a needle hole and a front face, a rear face, and opposed first and second sides. The lower surface of the base section has first and second surfaces each extending between the front face and rear face of the base section. The first surface is a planar surface extending substantially horizontally from the first side of the base section to a junction with the second surface. The second surface extends generally diagonally upwardly from the junction to the second side of the base section. The fulling rod extends below and spaced apart from the second surface over substantially the full length of the base section.

15 Claims, 5 Drawing Sheets

PRESSER FOOT FOR A SEWING MACHINE

BACKGROUND OF THE INVENTION

This invention relates to a presser foot for a sewing machine.

The mass-production garment industry is now heavily mechanised, and one technique that is commonly used for assembling together two or more garment parts is to use a stitching jig. Such jigs comprise a lower plate and an upper plate between which the garment parts may be held, and fulling means may also be present between the upper and lower plates in order that "fullness" may be introduced into required areas of the fabric. The lower plate of the jig has a guide track which, in use, is engaged with a guide member on the base plate of a sewing machine, with the fabric parts to be stitched together overlying the guide track. The guide member has an opening for the needle of a sewing machine and an elongated opening adjacent to the needle opening through which a trimming knife may be reciprocated. In use, the loaded jig is driven so that it moves beneath the needle and the trimming knife, with the guide track following the guide member. A line of stitching between the garment parts is effected along the line defined by the guide track, and unwanted material lying outside the stitch line is cut away by the trimming knife. The resulting composite garment part can then be removed from the jig for further processing.

It will be appreciated that the trimming knife cuts simultaneously through all the fabric layers, and thus that the distance from the stitch line to the free edge of each layer will be substantially identical.

In the manufacture of some high quality garments, a so-called "feathered edge" (or step-back edge) is required, and in order to form such an edge it is a requirement that the trimmed edges of the respective layers of fabric should not be equidistant from the stitch line, but that a further layer of fabric should extend beyond a second layer by a predetermined distance along the whole of the trimmed edge. Thus, the edge of the second layer is substantially uniformly stepped back from the edge of the first layer. The resultant single layer strip of first fabric is necessary in forming the feathered edge. This type of edge can be hand made, but has proved difficult to automate.

Our prior patent GB-B-2201694 relates to a presser foot for a sewing machine which is capable of automatically effecting a stepped back edge as fabric is fed through the machine. Although successful on some fabrics, the presser foot disclosed therein did not always give good results with all fabrics, and it was also necessary to trim more fabric than had previously been conventional, thereby leading to more waste. The present invention provides a presser foot which seeks to avoid these disadvantages.

SUMMARY OF THE INVENTION

According to the invention there is provided a presser foot.

In use of a presser foot according to the invention, a stitching jig loaded with the fabric parts to be joined together is presented to the presser foot, in which a guide track of the jig has already been engaged with a guide member on the base plate of the sewing machine. In the region where stitching is to commence, a free edge of the uppermost ply of fabric in the jig is separated from the lower ply or plies and presented to the fulling rod so that the uppermost ply lies above the fulling rod and the remaining ply or plies lie below the rod. As the jig is advanced past the needle, it will be seen that a degree of "fullness" is introduced into the upper ply, and that the plies are stitched together on one side of the fulling rod. On the other side of the fulling rod, the fabric plies are trimmed by a trimming knife which reciprocates synchronously with the needle, and with the knife moving to a top position lying above both fabric plies so that it can reliably trim the plies without puckering the fabric. Once the stitched parts have been removed from the jig and the stitched and trimmed edge has been smoothed so that the plies lie flat one on the other, it will be seen that the uppermost ply into which fullness was introduced will project beyond the cut edge of the lower ply or plies so that the cut edge of the lower ply or plies is stepped back from the cut edge of the uppermost ply. The stitched assembly can thus be used in the formation of a feathered edge.

In the presser foot described in GB-B-2201694, the fabric was overlain by the presser foot for a substantial distance to each side of the fulling rod. This tended to cause "puckering" or pleating of the fabric, which is avoided with the presser foot of the invention. With the earlier construction, it was necessary to provide a substantial width of fabric beneath the presser foot, with the result that more fabric than usual was removed as waste by the trimmer knife. Such extra waste fabric is not necessary with the presser foot of the invention.

Correct presentation of the fabric to the presser foot may be assisted, particularly for lightweight fabrics, if the presser foot includes an air supply means opening into a second surface of the presser foot to direct air away from that surface and above the fulling rod. An air flow of this type will tend to fold the top ply around the fulling rod, and hold it in a horizontal position, rather than possibly extending in a diagonally upward direction from that rod.

The fulling rod is desirably spaced from the second surface of the presser foot by a distance of about 2 to 4 mm, and preferably about 3 mm. The rod may have a rounded surface, or it may have a substantially flattened surface facing towards and substantially parallel to the second surface of the presser foot.

The second surface of the presser foot extends generally at an angle to the horizontal which is preferably from about 20 to 45°, and with an angle of 30 to 35° being particularly suitable. The second surface may be planar, but more preferably is inwardly curved to co-operate with the surface of the fulling rod.

The fulling rod may conveniently be secured to the base section by an extension of the fulling rod, with the extension lying clear of the groove. The shape of the extension may be such as to accommodate the fabric shapes that are to be stitched.

The cross-section and dimensions of the fulling rod will be designed to produce the desired degree of step back between the fabric plies. In addition to the flattened section of the fulling rod that faces towards the second surface of the presser foot, it is preferred that the lower surface of the fulling rod be flat and substantially horizontal in order to facilitate turning of the jig as corners of the guide track are reached.

BRIEF DESCRIPTION OF THE DRAWINGS

Preferred embodiments of presser foot according to the invention will now be described in detail, by way of example only, with reference to the accompanying drawings, in which.

DETAILED DESCRIPTION OF THE INVENTION

Figure 1:
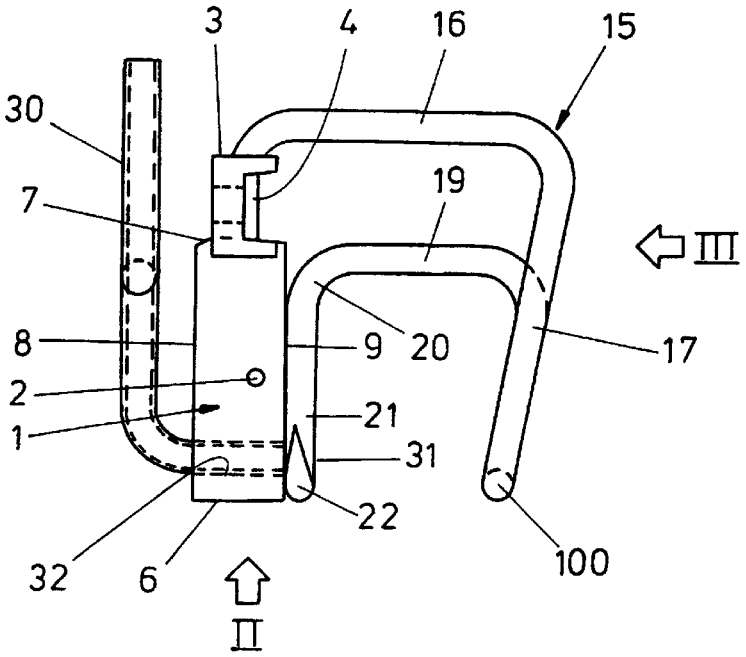
FIG. 1 is a top plan view of a first embodiment of presser foot.

The presser foot shown in FIG. 1 may be scratch made, or may be made by modifying a conventional presser foot. The foot has a base section designated generally by reference 1, through which is formed a needle hole 2. A support 3 projects upwardly from the base section and has a channel 4 by way of which the support may be engaged with the presser shaft of a sewing machine, the support being secured to the shaft by -a bolt passing through an opening 5.

The presser foot has an upwardly tapered front face 6, a rear face 7, a first side 8 and a second side 9. A first substantially planar bottom surface 10 and a second (preferably curved) surface 11 extending diagonally upwardly from the bottom surface 10. The first surface extends horizontally from the side 8 of the base section to a junction 12 with the second surface 11, and the second surface 11 extends generally diagonally upwardly from that junction to the second side 9 of the base section. The second surface 11 may be planar (not shown), in which case it makes an angle $\alpha$ to the horizontal; the preferred range for $\alpha$ is 30 to 35°, although it may be different from this range. However, it is preferred, as shown, for the second surface 11 to be inwardly curved to co-operate with an end portion 21 of a circular cross-section fulling rod, which is designated generally by reference 15.

Figure 2:
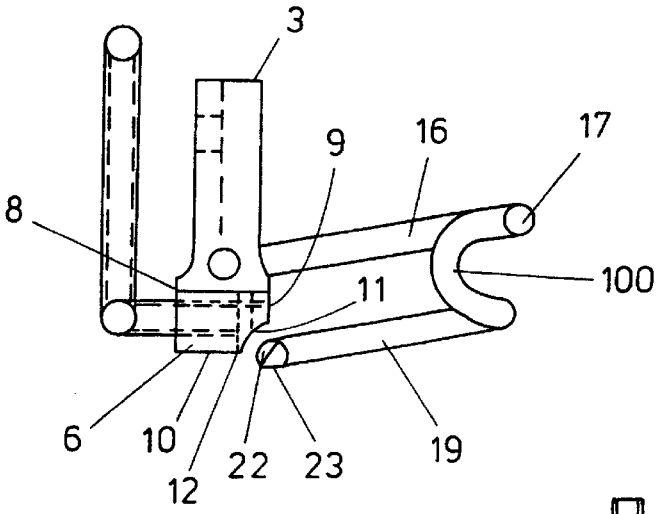
FIG. 2 is an end elevation in the direction of the arrow II in FIG. 1.
Figure 3:
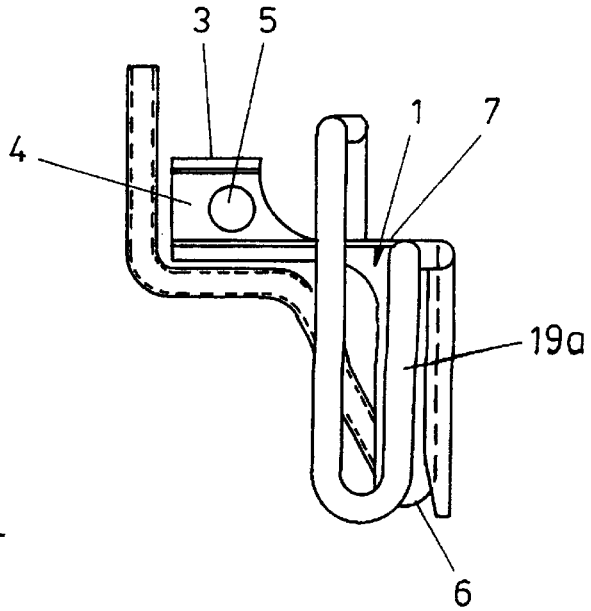
FIG. 3 is a side elevation in the direction of the arrow III in FIG. 1.

The circular section rod 15 is formed as shown in the figures. The rod has a first section 16 which is welded or otherwise secured to the rear face 7 of the presser foot at a level above the upper surface of the base section of the foot. The section 16 then curves forwardly into a section 17 which extends to a downwardly curved section 100 linking to a transversely extending section 19, via a connecting portion 19*a* underlying section 17. The lowermost part of section 19 extends at a level below the lower surface of the presser foot. The section 19 continues into a curved section 20 and this section in turn merges into a forwardly extending section which forms the end portion 21 and which constitutes a "fulling rod". As best seen in FIG. 2 the fulling rod preferably has a substantially planar surface 22 facing towards the second surface 11 of the presser foot and spaced from that presser foot by a distance that is preferably approximately 3 mm. The fulling rod also has a horizontal lower surface 23. The fulling rod extends below the second surface 11 and its longitudinal extent is from just in front of the front face 6 of the base section to adjacent the rear face 7 of the base section.

Preferably, and as shown in the plan view of FIG. 1, the forwardly extending section 17 tapers inwardly so that the spacing apart of section 100 from surface 22 is less than the spacing apart of the rear end of sectioi 17 from support 3. This facilitates guidance of the fabric between sections 16 and 19, and also permits easy location of a fibre optic head (not shown) of a photocell adjacent the forward end of section 17.

Further, as shown in FIG. 2, it is preferred that sections 16 and 19 extend generally parallel to each other and gently upwardly inclined away from support 3. This has the advantage of allowing the trimmed lower layer to pass under the section 19.

An air supply pipe 30 has an end 31 secured in a bore 32 formed in the presser foot. The bore opens into a surface lying behind the second surface 11, the opening being such as to direct air away from that surface and above the fulling rod in a substantially horizontal direction. The air supply pipe may be connected to an air supply on the sewing machine by tubing, not shown.

The presser foot (shown generally hy reference 200) is secured to an industrial sewing machine in convention manner, so that the needle 201 of the machine may pass through the needle hole 202 and the trimming knife 203 of the machine may pass adjacent to the side 209 of the presser foot. The base plate 40 of the machine is formed with an upstanding guide 41 which is also formed with a needle hole 42 and with a slot 43 for the trimming knife.

Upper and lower layers 44 and 45 of a fabric that are to be stitched together are loaded into a stitching jig comprising a lower plate 46 and an upper plate 47 and are held in the jig by engagement of the plates. The jig may incorporate fulling means as is well known in the art. The lower plate 46 of the jig is formed with a guide track 48, and the upper plate 47 terminates in a free edge 49 which overlies one edge of the guide track. The outer edge 50 of the lower plate is shaped to a profile corresponding to the guide track, and can be engaged by driving means (not shown) on the sewing machine in order to move the jig relative to the needle.

Figure 4A:
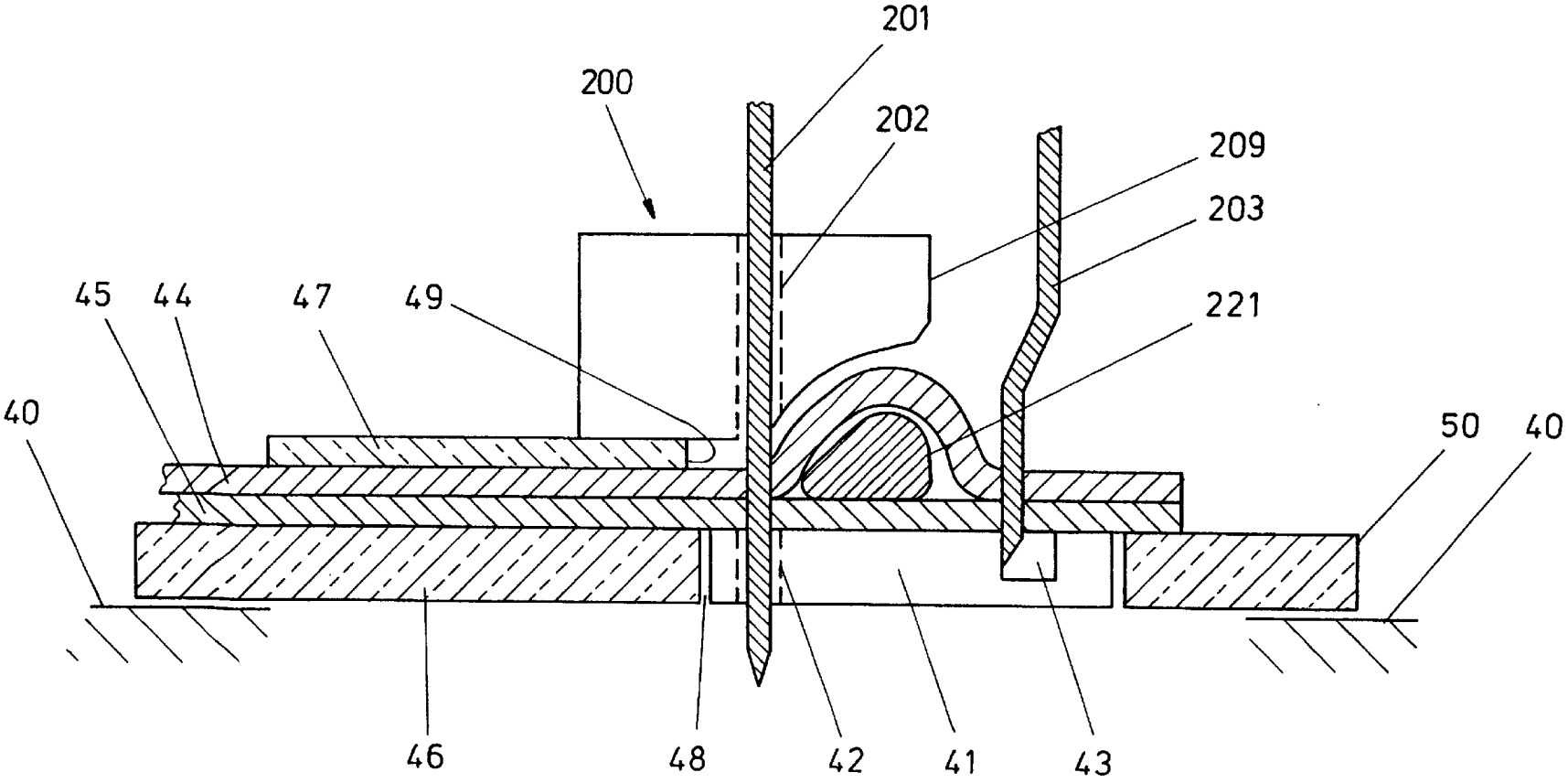
FIG. 4*a* is a sectional view showing the presser foot in use, i.e. the simultaneous operation of a stitching needle and a trimming knife.
Figure 4B:
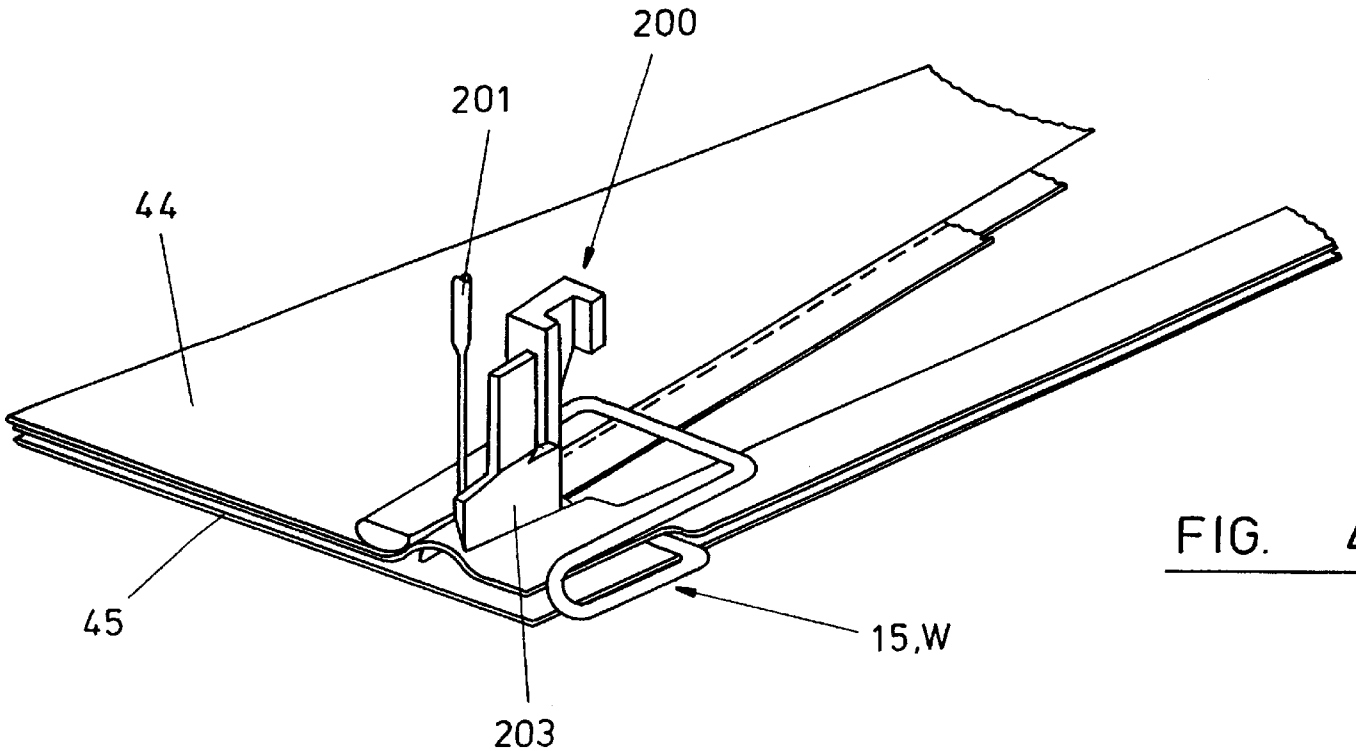
FIG. 4*b* shows the operation of the presser foot in conjunction with a jig.

As shown in FIG. 4, the loaded jig is presented to the machine and the track 48 is engaged over the guide 41 in the region where stitching is to commence. The upper layer 44 of fabric is separated from the lower layer 45 and the layers are arranged so that the lower layer remains beneath a fulling rod 221 while the upper layer passes over the fulling rod 221. Accordingly, fullness is introduced into the upper fabric layer between the region of the needle 201 and of the trimming knife 203. Stitching and simultaneous trimming can now commence, the jig being advanced through the machine beneath the presser foot, which holds the jig plates in their closed relationship with the fabric clamped firmly therebetween. A line of stitching is formed to one side of the fulling rod 221, while the excess fabric is cut away to the other side of the fulling rod 221.

The knife 203 is reciprocated vertically in synchronism with the needle in order to cut the fabric plies. On the downward stroke, the knife moves the fabric down and then cuts it. Air provided from the supply pipe 30 (FIG. 1) assists in folding the top ply over the fulling rod and holding it in a horizontal position overlying and in contact with the bottom ply.

Figure 5:
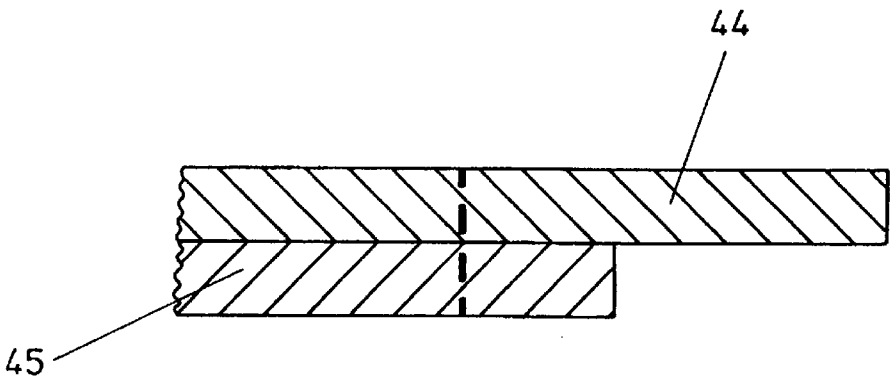
FIG. 5 illustrates a fabric assembly formed by the presser foot.

When stitching has been completed the stitched assembly is removed, and if the stitched and trimmed edge of the assembly is smoothed out it will be seen that the upper fabric layer 44 overlaps the cut edge of the lower fabric layer 45 by a distance dependent on the amount of fullness introduced by the fulling bar 21, as shown in FIG. 5.

The required set back relationship between the fabric edges has thus been achieved and the fabric assembly can be used in the formation of a feathered edge. The invention makes possible the automatic manufacture of fabric assemblies for forming this type of edge.

The flattened sections 22 and 23 (FIG. 1) on the fulling rod are not essential, but their presence is helpful in avoiding or at least mitigating distortion of the lower fabric ply as the jig is being turned to negotiate corners in the guide track.

It will be appreciated that the presser foot may be modified in a number of other ways, for example in the cross-section of the fulling rod and in the method of connection of the fulling rod to the base section. That connection may take any form that will not interfere with the free passage of the loaded jig beneath the presser foot as stitching is taking place.

The presser foot according to the invention, as defined herein, can be used in a fabrication process for obtaining "stepped edge trimming", and it should be understood that, according to a further aspect of the invention, there is provided a process for obtaining stepped back trimming.

Preferably, in the further aspects of the invention, a presser foot according to the invention is used. However, the present invention also contemplates a novel combination of process steps, to obtain stepped edge trimming, as disclosed herein.

Figure 6:
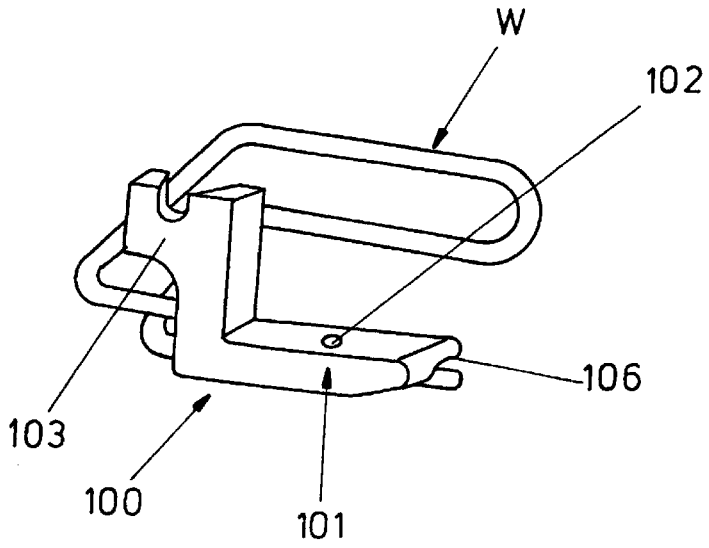
FIG. 6 is a perspective illustration from one side of a second embodiment of presser foot according to the invention.
Figure 7:
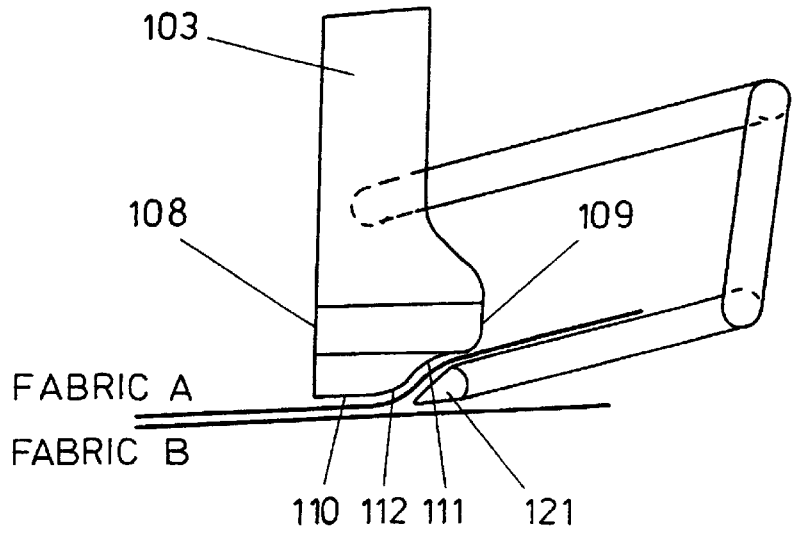
FIG. 7 is an end view of the second embodiment.
Figure 8:
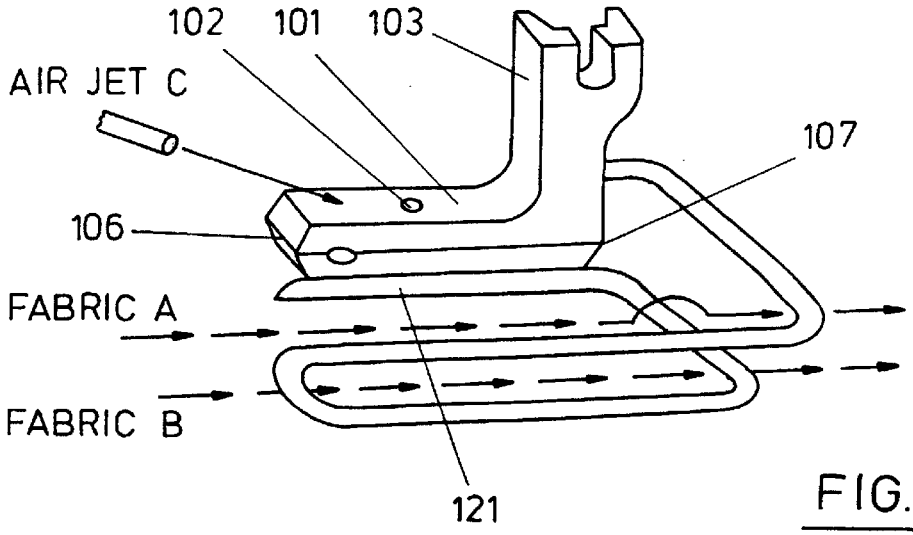
FIG. 8 is a perspective illustration from one side of the second embodiment; and, FIG. 9 shows a series of operating steps using of specially shaped blades to be attached to the fulling blade of a standard design of jig, for use with the presser foot according to the invention.

Referring now to FIGS. 6 to 8, this shows a second embodiment of presser foot according to the invention. The presser foot is designated generally by reference 100, and has a base section 101 formed with a needle hole 102, and a support 103 projecting upwardly from the base section 101 for attachment to a sewing machine. The base section has a front face 106, a rear face 107, and opposed first and second sides 108 and 109.

The lower surface of the base section 101 comprises a first substantially planar and horizontal surface 110, and a second surface 111 which extends generally diagonally upwardly and preferably is inwardly curved as shown.

The first surface 110 extends horizontally from the first side 108 to a junction 112 with the obliquely upwardly extending second surface 111, and the second surface 111 extends from the junction 112 to the second side 109.

The second embodiment of FIGS. 6 to 8 has a shaped wire guide W having a horizontal section 121 which extends alongside the second side 109 of the presser foot, with a small space defined between it and the presser foot, as seen particularly in FIG. 7. The section 121 therefore functions as a "fulling rod" which extends below and which is spaced apart from the second surface 111 over substantially the full length of the base section 101.

As shown schematically in FIG. 8, and also as shown in FIG. 7, fabrics A and B are fed below the presser foot 100, and also are guided by the wire guide W, in generally similar manner to the guidance of the fabric layers 44 and 45 in the first embodiment of presser foot shown in FIG. 1 to 4.

The shape of wire guide W allows the sewn and cut material (fabric layer A) to pass more easily through the back of the presser foot, and through the gap between the upper and lower rear (approximately horizontal) sections of the guide.

An air jet nozzle C (see FIG. 8), is arranged to blow in the direction shown in FIG. 8, through the upper and lower rear (approximately horizontal) sections of the wire guide. This jet of air encourages the fabric layer A to pass through the gap. In the absence of such an air jet, there is a risk that layer A may become entangled by the wire guide, and particularly when sewing and cutting around corners.

In addition to making the design more reliable, the two features referred to above allow the design to work around sharp corners, such as the peak lapelle of double breasted jacket fronts, and the points of collars.

Figure 9:
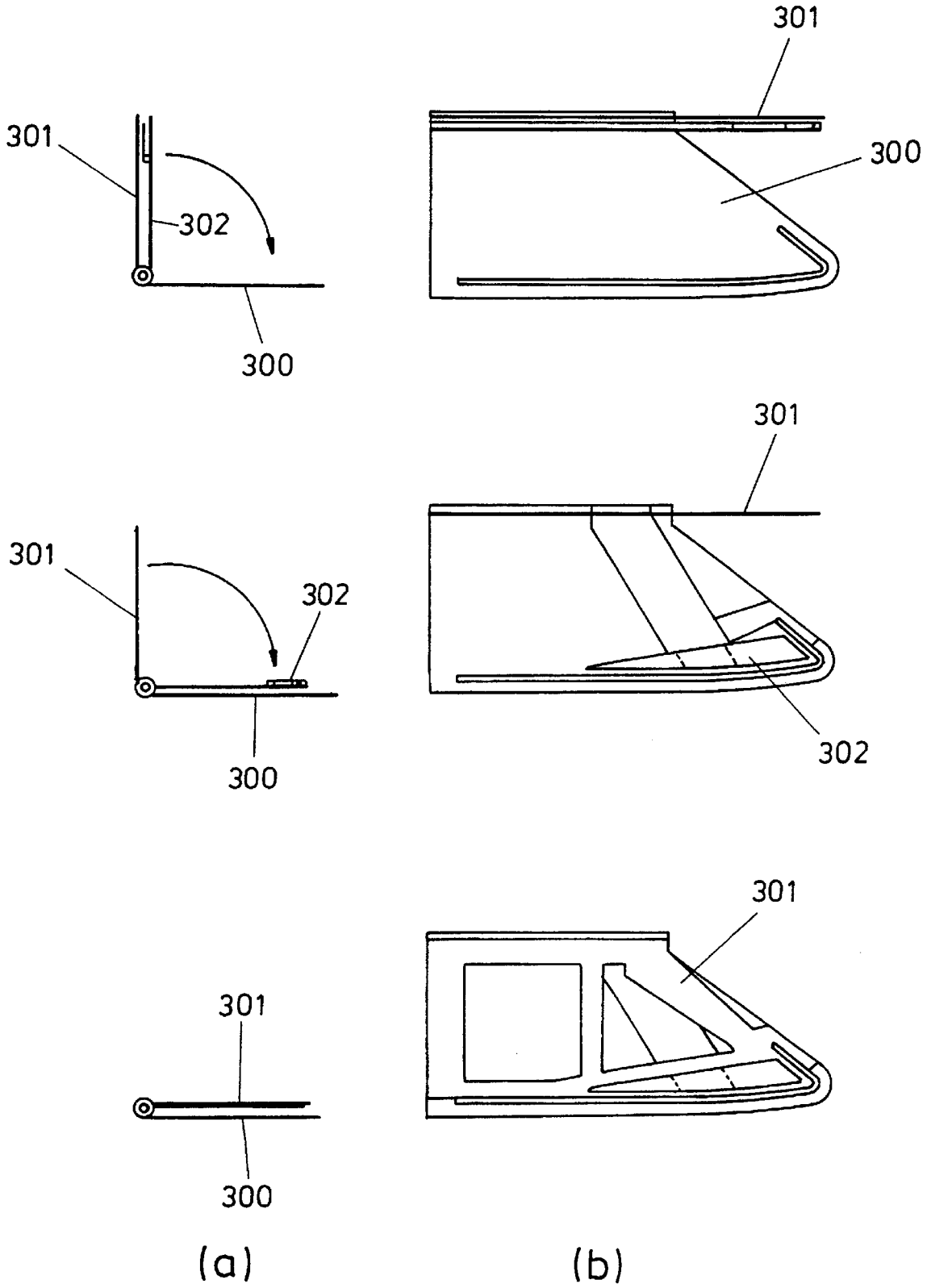

Finally, referring to FIG. 9, this shows a sequence of operations, using specially shaped blades to be attached to the fulling blade of a standard design of jig, for use with the presser foot according to the invention. In the left hand part of the figure, designated a, there is shown a sequence of three steps, whereby base plate of the jig 300 co-operates successively with specially designed fulling blade and separator 302, and top plate 301.

In the right hand side of the figure, under the designation b, there is a plan view illustration showing the same operating sequence steps.

The machine operator therefore loads the jig (when assembled with two layers of fabric (not shown) which are to be sewn and cut together) into a sewing machine, and then the presser foot of the invention (as shown in any of the embodiments described and illustrated herein) which is incorporated in the sewing machine then operates to provide a step-back feature. When utilising the wire guide W of the second embodiment shown in FIGS. 6 to 8, the two layers must be separated around the wire guide W, when the operator loads the jig into the machine. To aid this separation, specially shaped blades have been incorporated into the fulling blade and separator arrangement 302, and which are attached to the fulling blade proper of the jig.

If desired, the specially shaped loading blades may be hingedly mounted for movement between operative and inoperative positions.

What is claimed is:

1. A presser foot for a sewing machine which comprises:

a base section formed with a needle hole and having a front face a rear face and opposed first and second sides, and a support projecting upwardly from the base section for attachment to a sewing machine;

in which the lower surface of the base section comprises first and second surfaces each extending between said front face and rear face of the base section, with the first surface being a planar surface extending substantially horizontally from the first side of the base section to a junction with the second surface, and the second surface extending generally diagonally upwardly from said junction to the second side of the base section; and a fulling rod secured to the base section, the fulling rod extending below and spaced apart from the second surface over substantially the full length of the base section.

2. A presser foot according to claim 1, including an air supply means opening into the second surface of the presser foot to direct air away from that surface and above the fulling rod.

3. A presser foot according to claim 1, in which the fulling rod is spaced from the second surface of the presser foot by a distance of 2 to 4 mm.

4. A presser foot according to claim 1, in which the fulling rod has a rounded surface, or has a substantially flattened surface facing towards and substantially parallel to the second surface of the presser foot.

5. A presser foot according to claim 1, in which the angle $\alpha$ of the second surface of the presser foot to the horizontal is from 20 to 45°.

6. A presser foot according to claim 1, in which the second surface is inwardly curved to cooperate with the fulling rod.

7. A presser foot according to claim 1, in which the fulling rod is secured to the base section by an extension of the fulling rod, the extension lying clear of the groove.

8. A presser foot according to claim 1, in which the cross section and dimensions of the fulling rod are designed to produce a degree of step back between fabric plies.

9. A presser foot according to claim 8, in which a lower surface of the fulling rod is flat and substantially horizontal, in order to facilitate turning of a jig as corners of the jig's guide track are reached.

10. A presser foot according to claim 1, in which a fabric guide, shaped from wire, is attached to the base section of the presser foot, to guide the movement of fabric plies.

11. A presser foot according to claim 10, further comprising an air jet nozzle to guide the movement of an uppermost fabric ply layer through the wire fabric guide.

12. A presser foot according to claim 1, and in combination with a sewing jig, said sewing jig having a fulling blade and loading blades to assist in separation of fabric layers prior to guiding the layers over the fulling rod.

13. A method of step-back stitching and trimming of at least two superposed layers of fabric using a presser foot according to claim 1 comprising the steps:

presenting a stitching jig loaded with an uppermost ply of fabric and one or more remaining plies of fabric to the presser foot;

separating a free edge of the uppermost ply from the one or more remaining plies;

presenting the free edge to the fulling rod so that the uppermost ply lies above the fulling rod and the one or more remaining plies lie below the fulling rod;

introducing a degree of fullness into the upper ply as the jig is advanced past the needle and the plies are stitched together on one side of the fulling rod; and trimming the fabric plies with a trimming knife resulting in the one or more remaining plies having a trimmed edge stepped back from the trimmed edge of the uppermost ply.

14. A presser foot according to claim 1, in which the fulling rod is spaced from the second surface of the presser foot by a distance of about 3 mm.

15. A presser foot according to claim 1, in which the angle $\alpha$ of the second surface of the presser foot to the horizontal is from 30 to 35°.

* * * * *